US006470160B1

(12) United States Patent
Murakami

(10) Patent No.: US 6,470,160 B1
(45) Date of Patent: Oct. 22, 2002

(54) IMAGE FORMING APPARATUS WITH MANUAL SHEET FEEDER TRAY OR DISCHARGED-SHEET TRAY

(75) Inventor: Kazuhiro Murakami, Mitaka (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/744,011

(22) PCT Filed: Jul. 21, 1999

(86) PCT No.: PCT/JP99/03893

§ 371 (c)(1),
(2), (4) Date: Mar. 9, 2001

(87) PCT Pub. No.: WO00/05627

PCT Pub. Date: Feb. 3, 2000

(30) Foreign Application Priority Data

Jul. 21, 1998 (JP) ..... 10-205525

(51) Int. Cl.[7] ..... G03G 15/20
(52) U.S. Cl. ..... 399/124; 399/125
(58) Field of Search ..... 399/107, 124, 399/125, 392, 405; 271/8.1, 9.09

(56) References Cited

U.S. PATENT DOCUMENTS 4,583,844 A * 4/1986 Honda ..... 399/124
4,835,567 A * 5/1989 Ogata ..... 399/124

FOREIGN PATENT DOCUMENTS

| | | |
|---|---|---|
| JP | 60-149052 | 8/1985 |
| JP | 1-140551 | 9/1989 |
| JP | 3-38859 | 4/1991 |
| JP | 7-44082 | 2/1995 |

* cited by examiner

*Primary Examiner*—Sophia S. Chen
*Assistant Examiner*—Hoan Tran
(74) *Attorney, Agent, or Firm*—Dellett & Walters

(57) ABSTRACT

An image-forming apparatus employs a manual sheet feeder tray that overlaps a part of a side wall of an upper main body portion to be in contact therewith in a non-working mode irrespective of an opener assembly being open or closed. A guide member can be provided to prevent contact of the manual sheet feeder tray with the upper main body portion. Further, an image-forming apparatus employs a discharged-sheet selectively positionable for a working mode or a non-working mode, where the discharged-sheet tray overlaps a part of a side wall of the upper main body when in the non-working mode, irrespective of an opener assembly being opened or closed. A guide member can be provided to prevent contact of the discharged-sheet tray with the upper main body portion.

4 Claims, 6 Drawing Sheets

IMAGE FORMING APPARATUS WITH MANUAL SHEET FEEDER TRAY OR DISCHARGED-SHEET TRAY

TECHNICAL FIELD

The present invention relates to an image-forming apparatus such as copying machines, printers, and plotters.

BACKGROUND TECHNIQUE

As an output apparatus for computers and workstations, there are known ink-jet type image-forming apparatuses which form an image by ejecting an ink on a recording sheet, and electrophotography type image-forming apparatuses which form an image with a developer on a recording sheet. Such an image-forming apparatus has an image formation unit for forming an image. Usually, the image-forming apparatus has a sheet feeder unit which feeds a recording sheet to the image formation unit, and a sheet discharge unit equipped opposite to the sheet feed unit with interposition of the image formation unit. Thereby, a recording sheet delivery path is formed for delivering the recording sheet from the sheet feed unit to the sheet discharge unit.

Some image-forming apparatuses are of a two-separation type (so-called clamshell type) which is separable into an upper main body portion and a lower main body portion around a turning axis at the one end side (rear side of the main body) across the recording sheet delivery path to be openable from the side opposite to the turning axis (front side of the main body). The clamshell type image-forming apparatus is designed to be openable widely to expose the recording sheet delivery path, whereby the user can readily deal with sheet clogging (jamming).

Of the above clamshell type of image-forming apparatuses, an electrophotography type one has an optical system and a photosensitive drum in the upper main body portion, and has a cassette tray and a fixation unit in the lower main body portion. The lower main body portion is set unmovably, and the openable upper main body portion is constituted to be capable of being pushed up from the front side by a damper charged with air or a like matter.

Some of the aforementioned type of the image-forming apparatuses have a manual sheet feeding unit having a manual feeder tray in the lower main body portion. The manual feeder tray, which is usually rectangular in shape, is hinged turnably at a first side edge to the side wall of the lower main body, and a second side edge opposite thereto is turnable around the first side edge as the tuning axis. The manual feeder tray is foldable to come to be in close contact with the side walls of both the lower main body and the upper main body. The folded manual feeder tray is energized inward to the side wall by a spring or the like not to leave the side walls by its own gravity when it is not used. The manual feeder tray, when it is used, is opened by pulling out the second side edge around the first side edge as the turning axis.

The sheet discharge unit has usually a discharged-sheet tray for holding image-carrying discharged sheets. This discharged-sheet tray can holds various size of recording sheets, from a small size sheet to a large size sheet. The large sheet size herein means an A3 size or a B4 size, and the small size means a calling card size or a postcard size. A discharged-sheet tray is known which is folded up into the main body wall when the image is formed on a recording sheet of a small size or the image forming-apparatus is not used.

Many image-forming apparatuses have a flat side face having a depression formed on a part of the side walls of the upper and lower main bodies for fitting the manual feeder tray. The depth of the depression is approximate to the thickness of the manual feeder tray for compactness of the image-forming apparatus.

However, with such an insufficient depth of the depression, a part of the folded manual feeder tray may come to be inclined into the main body when the upper main body portion is opened. In this state, if the upper main body portion is brought down to close, the part of the manual feeder tray can be broken by collision against the upper main body portion owing to dimensional variations of the manual feeder tray or variation in the assemblage thereof. Such a damage may occur with the discharged-sheet tray.

DISCLOSURE OF THE INVENTION

Under the aforementioned circumstances, the object of the present invention is to provide an image-forming apparatus which does not cause damage of a manual feeder tray or a discharged-sheet tray regardless of a dimensional variation in parts of the manual feeder tray or of the discharged-sheet tray or in assemblage thereof, when the upper main body portion is opened or closed.

A first embodiment of the image-forming apparatus of the present invention for achieving the above object has a recording sheet-delivery path for delivering a recording sheet from a sheet feed unit to a sheet discharge unit in an opposite side; and is separable into two portions of an upper main body portion and a lower main body portion by opening an opener assembly from one side edge of the upper main body portion around a turning axis provided at the other side edge thereof across the recording sheet delivery path, the image-forming apparatus comprising:

a nearly rectangular manual sheet feeder tray having (1) a first edge portion extending in a direction crossing the recording sheet delivery path, and being hinged turnably to the lower main body portion at the side of the sheet feed unit, and (2) a second edge portion being positioned near a space between the upper main body portion pushed up by the opener assembly and the lower main body portion on a sheet feed unit side and extending at the side opposite to the first edge portion and in the crossing direction, (3) the manual sheet feeder tray being positioned selectively for a working mode by bringing down the second edge portion by turning around the first edge portion, or for a non-working mode by turning up the second edge portion around the first edge portion as the turning axis to be fixed; and (4) the manual sheet feeder tray overlapping a part of a side wall of the upper main body portion to be in contact therewith in the non-working mode irrespective of the opener assembly being open or close.

A second embodiment of the image-forming apparatus of the present invention for achieving the above object has a recording sheet-delivery path for delivering a recording sheet from a sheet feed unit to a sheet discharge unit in an opposite side; and is separable into two portions of an upper main body portion and a lower main body portion by opening an opener assembly from one side edge of the upper main body portion around a turning axis provided at the other side edge thereof across the recording sheet delivery path, the image-forming apparatus comprising:

a nearly rectangular manual sheet feeder tray having (5) a first edge portion extending in a direction crossing to the recording sheet delivery path, and being hinged turnably to the lower main body portion at the side of the sheet feed unit, and (6) a second edge portion being positioned near a space between the upper main body portion pushed up by the opener assembly and the lower main body portion on a sheet feed unit side and extending at the side opposite to the first edge portion and in the crossing direction, (7) the manual sheet feeder tray being positioned selectively for a working mode by bringing down the second edge portion by turning around the first edge portion, or for a non-working mode by turning up the second edge portion around the first edge portion as the turning axis to be fixed; and (8) comprising a guide member for guiding the manual sheet feeder tray temporarily outside the upper main body portion in dosing the upper main body portion from an open state to prevent contact of the manual sheet feeder tray with the upper main body portion.

A third embodiment of the image-forming apparatus of the present invention for achieving the object of the present invention has a recording sheet-delivery path for delivering a recording sheet from a sheet feed unit to a sheet discharge unit in an opposite side; and is separable into two portions of an upper main body portion and a lower main body portion by opening an opener assembly from one side edge of the upper main body portion around a turning axis provided at the other side edge thereof across the recording sheet delivery path, the image-forming apparatus comprising:

a discharged-sheet tray having (9) a first edge portion extending in a direction crossing the recording sheet delivery path, and being hinged turnably to the lower main body portion at the side of the sheet discharge unit, and

(10) a second edge portion being positioned near a space between the upper main body portion pushed up by the opener assembly and the lower main body portion on a sheet feed unit side and extending at the side opposite to the first edge portion and in the crossing direction,

(11) the discharged-sheet tray being positioned selectively for a working mode by bringing down the second edge portion by turning around the first edge portion, or for a non-working mode by turning up the second edge portion around the first edge portion as the turning axis to be fixed, and

(12) the discharged-sheet tray overlapping a part of a side wall of the upper main body portion to be in contact therewith in the non-working mode irrespective of the opener assembly being open or close.

A fourth embodiment of the image-forming apparatus of the present invention for achieving the object of the present invention has a recording sheet-delivery path for delivering a recording sheet from a sheet feed unit to a sheet discharge unit in an opposite side; and is separable into two portions of an upper main body portion and a lower main body portion by opening an opening assembly from one side edge of the upper main body portion around a turning axis provided at the other side edge thereof across the recording sheet delivery path, the image-forming apparatus comprising:

a discharged-sheet tray having

(13) a first edge portion extending in a direction crossing the recording sheet delivery path, and being hinged turnably to the lower main body portion at the side of the sheet discharge unit, and

(14) a second edge portion being positioned near a space between the upper main body portion pushed up by the opener assembly and the lower main body portion on a sheet feed unit side and extending at the side opposite to the first edge portion and in the crossing direction,

(15) the discharged-sheet tray being positioned selectively for a working mode by bringing down the second edge portion by turning around the first edge portion, or for a non-working mode by turning up the second edge portion around the first edge portion as the turning axis to be fixed; and

(16) comprising a guide member for guiding the discharged-sheet tray temporarily outside the upper main body portion in closing the upper main body portion from an open state to prevent contact of the discharged-sheet tray with the upper main body portion.

BEST MODE FOR PRACTICING THE INVENTION

An embodiment of the image-forming apparatus of the present invention is explained by reference to drawings.

Figure 1:
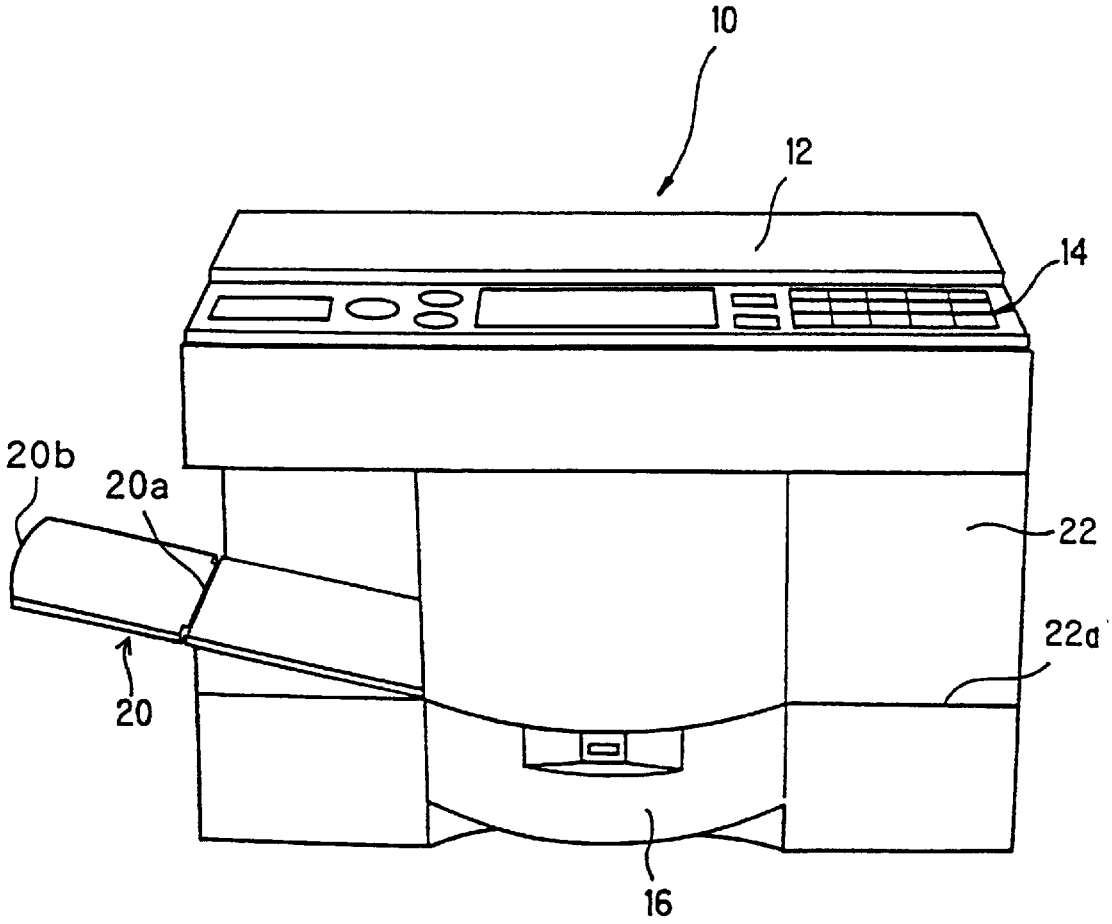
FIG. 1 is a perspective view showing external appearance of a copying machine of an embodiment of the image-forming apparatus of the present invention.

FIG. 1 is a perspective view showing external appearance of a copying machine of an embodiment of the image-forming apparatus of the present invention.

On the top face of the copying machine 10 (an example of the image-forming apparatus of the present invention), there is placed an openable document-pressing plate 12. An operation panel display 14 is placed at the front side of the top face for inputting a reproduction copy number, and other operation conditions. The copying machine 10 is provided with a universal cassette 16 demountable from the front face side of the copying machine 10. On the right wall of the copying machine 10, there is provided a rectangular manual feeder tray 18 (see FIG. 2) for feeding a small-sized recording sheet like a postcard. This manual feeder tray 18 can be turned outside around the lower side edge portion (a first side edge portion) 18*a* as the turning axis in the arrow-C direction to be opened for loading a recording sheet (the position indicated by the two-dot chain line). The state of the opened manual tray 18 is a working mode. On the other hand, the state of the tray with the second side edge portion opposite to the first edge portion 18*a* turned upward is a non-working mode. On the left wall of the copying machine 10, a discharged-sheet tray 20 is provided for receiving the recording sheets.

Figure 2:
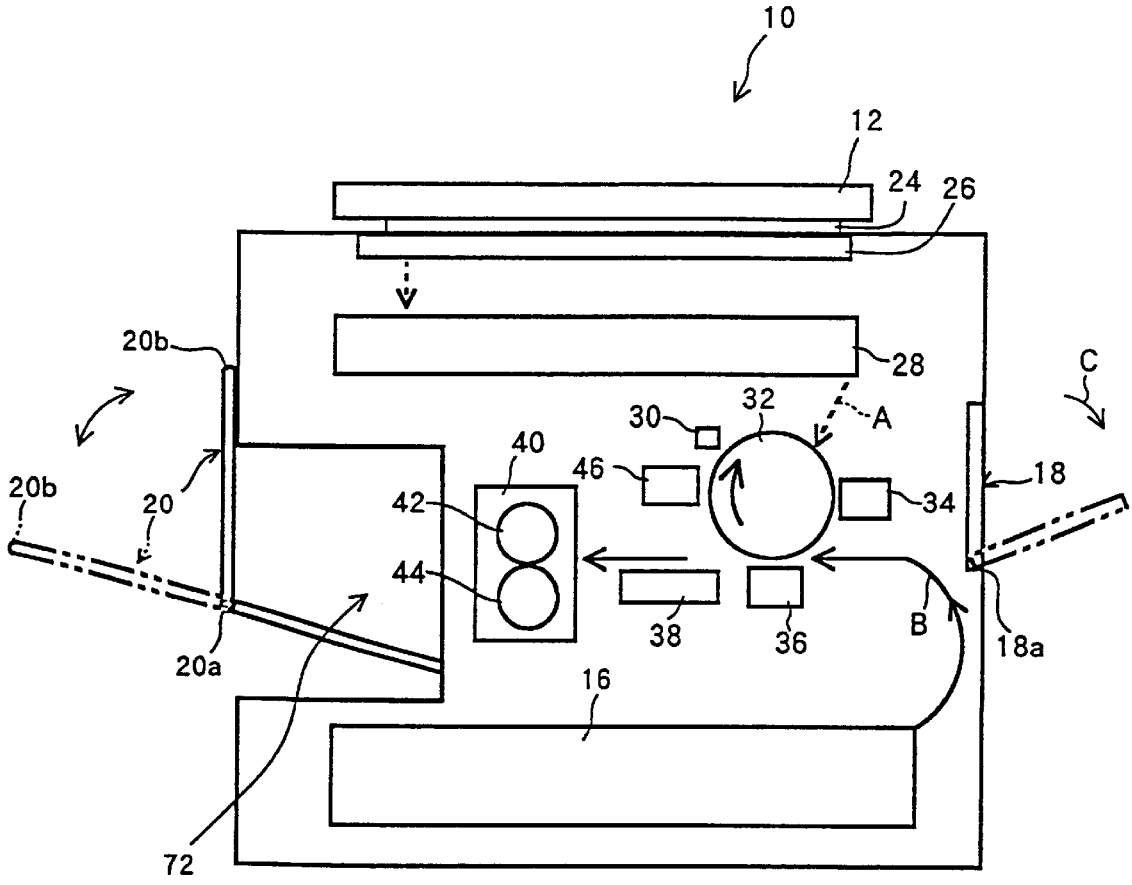
FIG. 2 illustrates schematically a structure of the inside of the copying machine of FIG. 1.

The copying machine 10 has a rectangular front door 22 on the front side to be openable frontward around the lower side edge portion 22*a* as the turning axis. The interior of the copying machine 10 can be observed by opening this front door 22. With this front door 22 opened, the front side portion of the upper main body portion (portion housing an optical system 28, a photosensitive drum 32, etc. as shown in FIG. 2) of the copying machine 10 can be pushed up by a repulsion force of a pair of dampers 60,62 (FIGS. 3, and 4) when a pair of hooks 50,52 (FIGS. 3 and 4) disposed near the front door 22 are disengaged. Thereby the copying machine 10 is separated into two portions of the upper main body portion and the lower main body portion (the lower portion incorporating the universal cassette 16, etc.).

The process for forming an image with the copying machine 10 of FIG. 1 is explained by reference to FIG. 2.

FIG. 2 illustrates schematically a structure of the interior of the copying machine 10. In FIG. 2, the same reference numbers are used for corresponding elements as in FIG. 1.

Under the document-pressing plate 12, a document-supporting glass plate 26 is provided for supporting an original document 24. The original document 24 is placed with the image face directed downward on the document-supporting glass plate 26, and is fixed by pressing by the document-pressing plate 12. The image recorded on the original document 24 is read by an optical system 28, and the light introduced is modulated (broken line A) to carry the information of the image recorded on the original document. This light is projected to a photosensitive drum 32 having been uniformly electrified by an electrifier 30 to form an electrostatic latent image. This electrostatic latent image is developed by a developing agent (toner) supplied from development unit 34. Separately, a recording sheet like recording paper sheet is sent out from the universal cassette 16, and is delivered in an arrow-B direction. The developed image is transferred by an image transfer unit 36 onto the recording sheet.

The recording sheet having received a transferred developed image is delivered by a delivery unit 38 to the fixation unit 40. The fixation unit 40 comprises a heat roller 42 and a pressure roller 44. The recording sheet is nipped and delivered by the two rollers 42,44, thereby the developed image being fixed on the recording sheet. The recording sheet having the developed image fixed thereon is discharged and is place on the discharged-sheet tray 20. Incidentally, the toner remaining on the photosensitive drum 32 after the image transfer is scraped by a cleaning unit 46. Otherwise, the recording sheet can be fed from the manual feeder tray 18, and the image formation can be conducted in the same manner as above onto the recording sheet fed from the manual feeder tray 18.

The copying machine can be separated into two portions of the upper main body and the lower main body by pushing up the upper main body portion of the copying machine. This separation is explained by reference to FIGS. 3 and 4.

Figure 3:
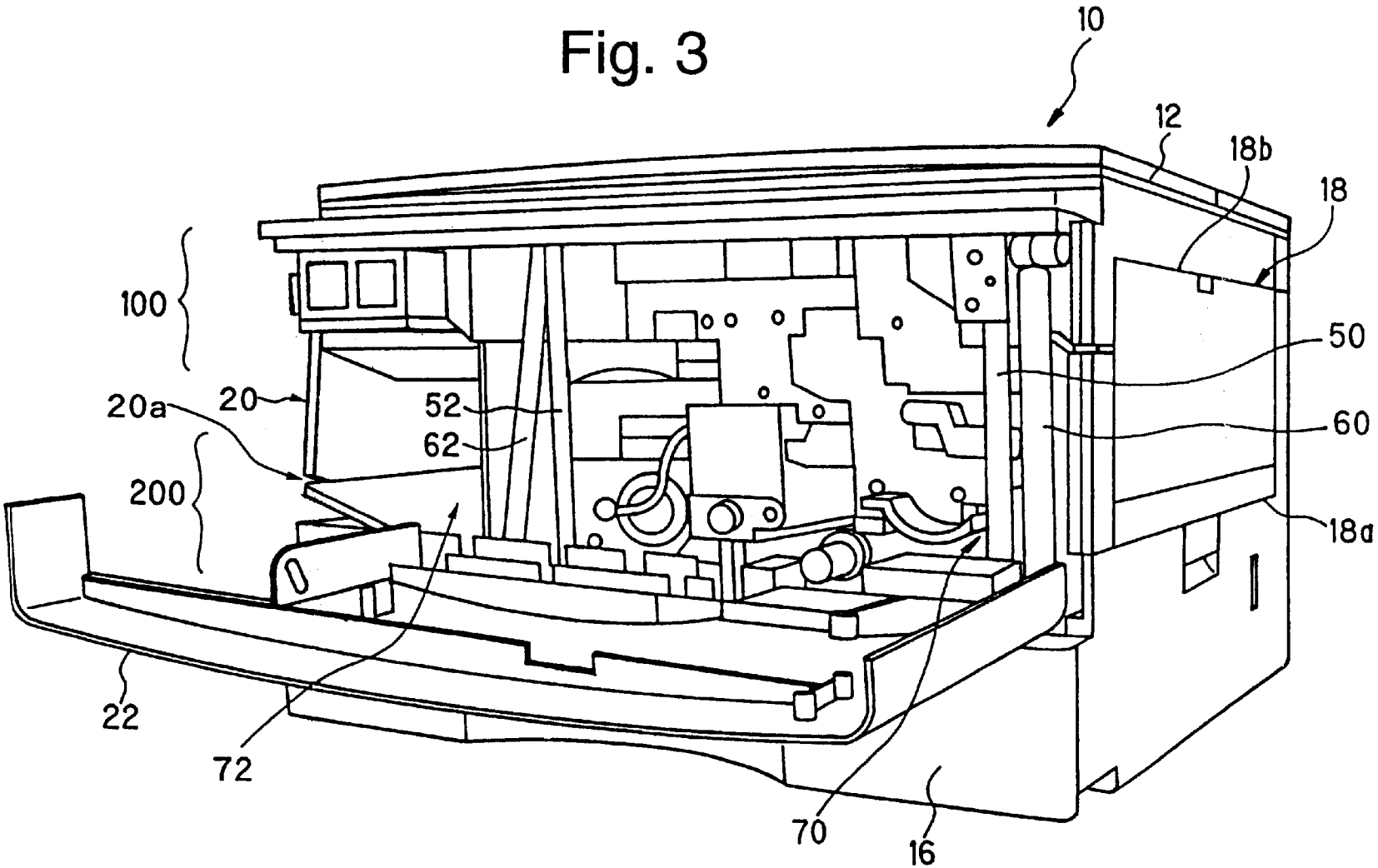
FIG. 3 is a perspective view of a copying machine with the front door opened.
Figure 4:
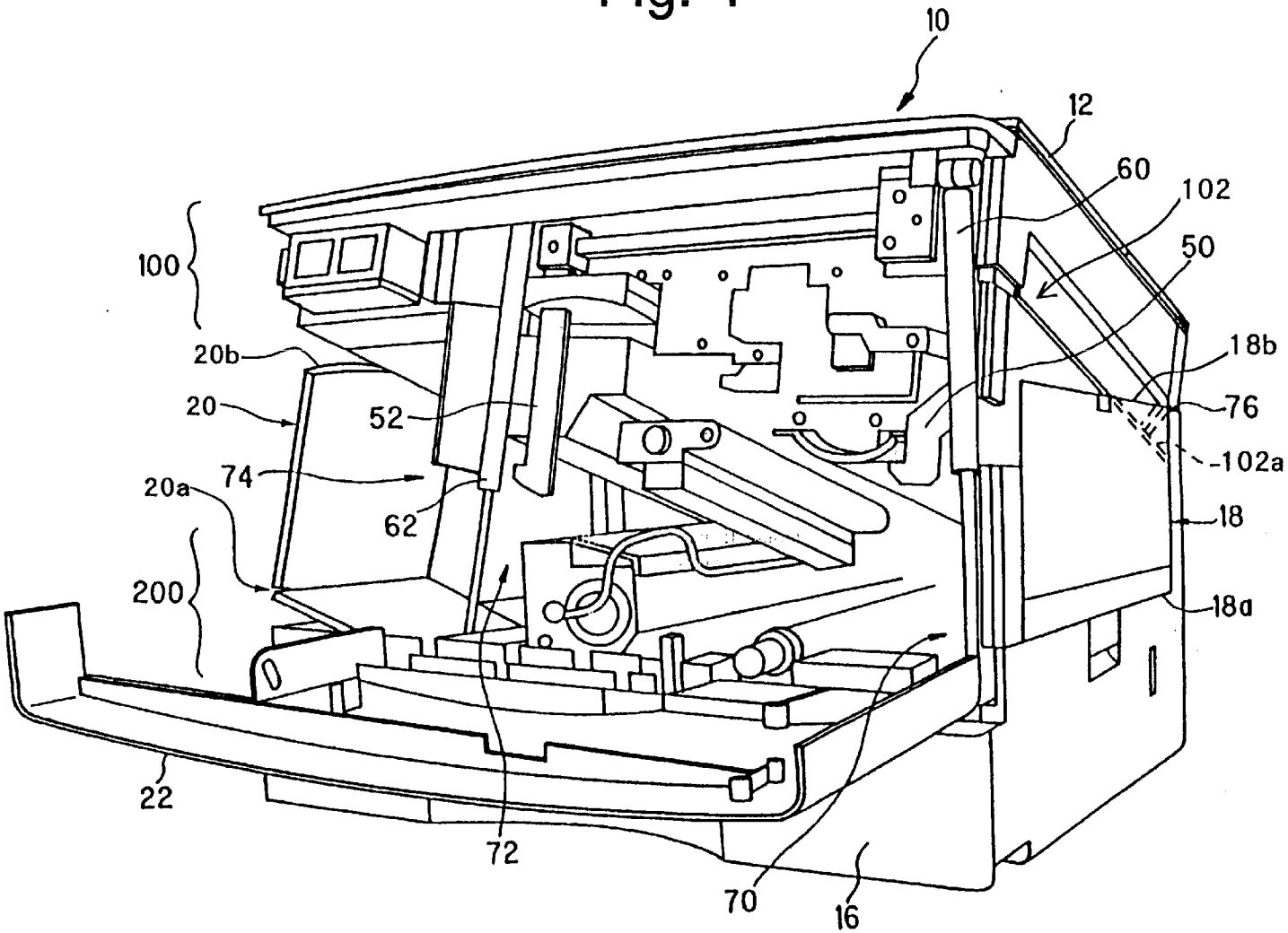
FIG. 4 is a perspective view of a copying machine having the front door opened and the upper main body portion pushed up.

FIG. 3 is a perspective view of a copying machine with the front door opened FIG. 4 is a perspective view of a copying machine with the front door opened and with the upper main body portion pushed up. In these drawings, the same reference numbers are used for the corresponding constitutional element as in FIGS. 1 and 2.

In a copying machine 10, the recording sheet sent out from the universal cassette 16 is delivered through a sheet feeder unit 70 at the right side as shown in FIGS. 3 and 4 to the inside of the copying machine 10. The recording sheet having received the formed image in the copying machine 10 is discharged through a discharge unit 72 onto the discharged-sheet tray 20. Thus, a recording sheet delivery path is constituted for delivering the recording sheet from the sheet feeder unit 70 to the sheet discharge unit 72 in the copying machine 10.

The copying machine 10 is separable into two portions of the upper main body portion 100 (the portion incorporating an optical system 28, a photosensitive drum 32, etc. as shown in FIG. 2) and the lower main body portion 200 (the portion incorporating a universal cassette 16, etc.). The opener assembly 74 opens the copying machine 10 from the front side by pushing the front portion of the upper main body portion 100 by a pair of dampers 60,62. The damper 60 is placed near the sheet feed unit 70 in the front side of the copying machine 10. The damper 62 is placed near the sheet discharge unit 72 in the front side of the copying machine 10.

The opener assembly 74 conducts opening and closing around a turning axis 76 as the turning center provided at a rear wall (not shown in the drawing) of the main body of the copying machine 10. The opener assembly 74 and the turning axis 76 are located at the side across the aforementioned recording sheet delivery path. A pair of dampers 60,62 are fixed at predetermined positions. The manual feeder tray 18 is rectangular in shape as shown in FIGS. 3 and 4. The one side edge 18*a* extends nearly perpendicularly to the recording medium delivery path, and is fixed rotatably at the side wall on the side of the sheet feed unit 70 in the lower main body portion 200. The other side edge 18*b* opposite to the side edge 18*a* of the manual feeder tray 18 also extends nearly perpendicularly to the recording sheet delivery path.

The side walls of the upper main body portion 100 and of the lower main body portion have a depression 102 for fitting the manual feeder tray 18 therein. When the upper main body portion 100 is opened fully, a part 102*a* of the side wall (corresponding to the bottom wall of the depression 102) overlaps the manual feeder tray 18. Thereby, the manual feeder tray 18 is prevented from inclining into the inside of the upper main body portion 100. Therefore, in closing the upper main body 100, the second side edge 18*b* of the manual feeder tray 18 is prevented from colliding against the upper main body portion 100, whereby breakdown of the manual feeder tray can be prevented and the upper main body portion 100 can be closed smoothly.

The discharged-sheet tray 20 is also rectangular in shape as shown in FIGS. 3 and 4. The one edge 20*a* thereof extends nearly perpendicularly to the recording sheet delivery path, and is fixed turnably to the side wall of the side of the discharge unit 72 of the lower main body portion 200. The other edge 20*b* of the discharged-sheet tray opposite to the edge 20*a* also extends nearly perpendicularly to the recording sheet delivery path.

The discharged-sheet tray 20 is fold up, when the upper main body portion 100 is opened fully, when a small-sized recording sheets are discharged and stored on the discharged-sheet tray 20, or when the discharged-sheet tray 20 is not used (examples of the non-working mode), a part of the side wall (outside wall) of the discharge unit 72 overlaps the discharged-sheet tray 20. Therefore, in closing the upper main body 100, the other edge 20*b* of the discharged-sheet tray 20 is prevented from inclining into the inside of the upper main body portion 100, and is prevented from colliding against the upper main body portion 100, whereby breakdown of the discharge-sheet tray 20 can be prevented and the upper main body portion can be closed smoothly.

Figure 5:
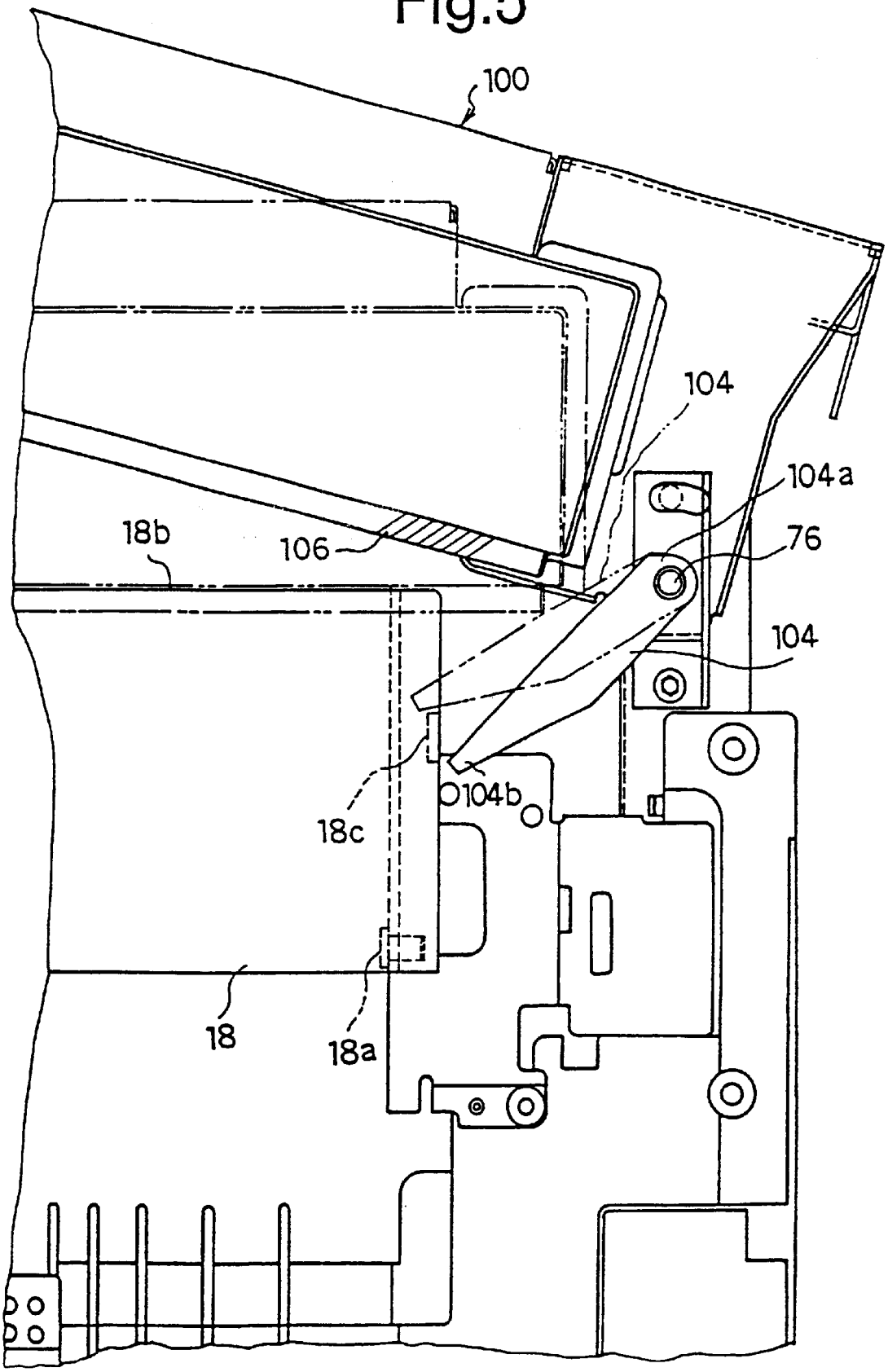
FIG. 5 is an enlarged side view of a part of the opened upper main body portion and the manual feeder tray in a non-working mode.
Figure 6:
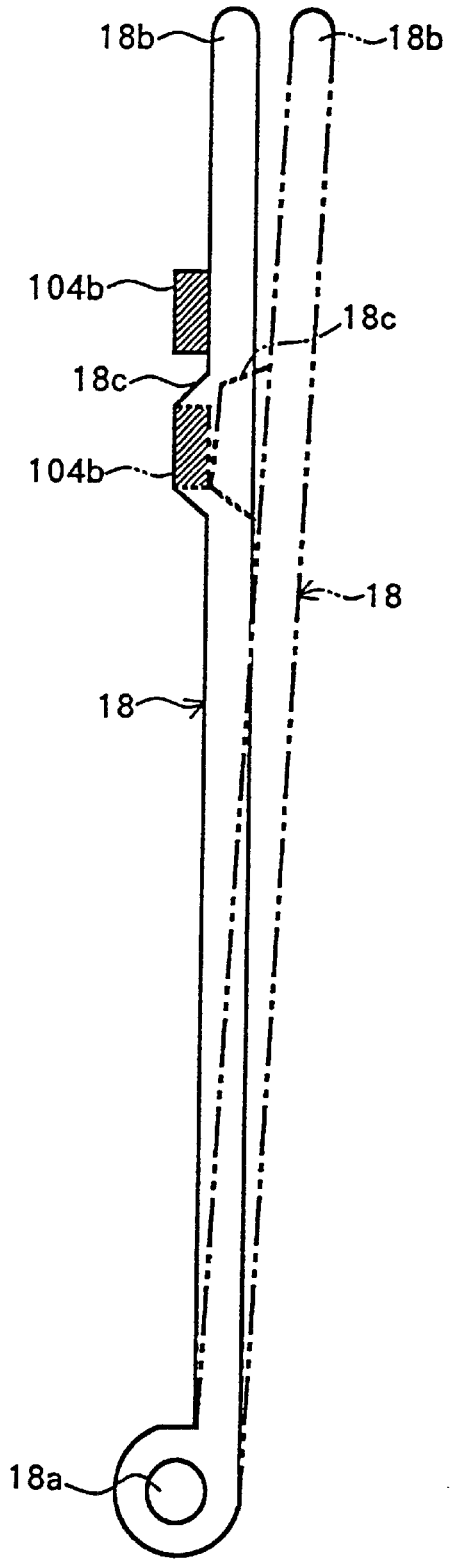
FIG. 6 is a side view of a guide member.

Another example is explained of prevention of the breakdown of the manual feeder tray in dosing the upper main body portion 100 by reference to FIGS. 5 and 6. In this example, being different from FIG. 4, a part 102*a* of the fully opened upper main body portion 100 does not overlap partially a manual feeder tray 18. Therefore the manual feeder tray 18 can incline into the inside of the upper main body portion 100.

FIG. 5 is an enlarged side view of a part of the opened upper main body portion and the manual feeder tray in a non-working mode. FIG. 6 is a side view of a guide member.

To a turning axis 76 of the upper main body 100, a guide arm 104 extending in the direction perpendicular to the turning axis 76 toward the manual feeder tray 18 is fixed at one end 104*a*. On the other hand, a guide rib 18*c* is formed at the end portion of the manual feeder tray 18 in the breadth direction so as to protrude toward the inside of the main body. The guide arm 104 and the guide rib 18*c* constitute a guide member of the present invention.

When the upper main body portion 100 is open, the other end 104*b* of the guide arm 104 is positioned above the guide rib 18*c* of the manual feeder tray 18. Therefore, the end 104*b* and the guide rib 18*c* do not interfere with each other. When the upper main body portion 100 is closed, if the manual feeder tray 18 is inclined into the inside of the upper main body portion 100, a part 106 of the upper main body portion 100 can collide against the second edge 18*b* of the manual feeder tray 18 to damage the manual feeder tray 18.

In this example, however, as shown in FIG. 6, when the upper main body portion is closed, the second edge 104*b* of the guide arm 104 pushes out the guide rib 18*c* of the manual feeder tray 18 to shift temporarily the second edge 18*b* of the manual feeder tray 18 outside to the position shown by two-dot chain line. The shift (distance) is designed not to cause contact of a part 106 of the upper main body 100 with the second edge 18*b* of the manual feeder tray 18. With the guide rib 18*c* pushed outside, the part 106 of the upper main body portion 100 will not be brought into contact with the second edge 18*b* of the manual feeder tray 18 in the operation of dosing the upper main body portion 100. Consequently, the upper main body portion can be closed smoothly without damaging the manual feeder tray 18. When the part 106 of the upper main body portion 100 has been dosed, the second end 104*b* of the guide arm 104 leaves the guide rib 18*c* of the manual feeder tray 18 to restore the manual feeder tray 18 to the original position.

A discharged-sheet tray 20 provided with a similar guide rib and a guide arm attains the object of the present invention.

INDUSTRIAL APPLICABILITY

As explained above, in the first embodiment of the image forming apparatus of the present invention, the manual feeder tray comes into contact with the side wall of the upper main body portion when the upper main portion is opened, so that the manual feeder tray is prevented from entering the inside of the upper main body portion. Therefore, even with small dimensional variation of the manual feeder tray parts or in assemblage, the manual feeder tray will not be damaged by collision against the upper main body portion in the operation of dosing the upper main body portion.

In the second embodiment of the image forming apparatus of the present invention, the manual feeder tray is temporarily guided outside the upper main body portion by the guide member during operation of dosing the upper main body portion to prevent the manual feeder tray from entering the inside of the upper main body portion. Therefore, even with a small dimensional variation of the manual feeder tray parts or variation in assemblage, the manual feeder tray will not be damaged by collision against the upper main body portion in the operation of closing the upper main body portion.

In the third embodiment of the image forming apparatus of the present invention, the discharged-sheet tray overlaps the side wall of the upper main body portion when the upper main portion is opened, so that the discharged feeder tray is prevented from entering the inside of the upper main body portion. Therefore, even with a small dimensional variation of the discharged-sheet tray parts or variation in assemblage, the discharged-sheet tray will not be damaged by collision against the upper main body portion in the operation of closing the upper main body portion.

In the fourth embodiment of the image forming apparatus of the present invention, the discharged-sheet tray is temporarily guided outside the upper main body portion by the guide member during operation of dosing the upper main body portion to prevent the discharged-sheet tray from entering the inside of the upper main body portion. Therefore, even with dimensional variation of the discharged-sheet tray parts or variation in assemblage, the discharged-sheet tray will not be damaged by collision against the upper main body portion in the operation of dosing the upper main body portion.

What is claimed is:

1. An image-forming apparatus having a recording sheet-delivery path for delivering a recording sheet from a sheet feed unit to a sheet discharge unit in an opposite side; and being separable into two portions of an upper main body portion and a lower main body portion by opening an opener assembly from one side edge of the upper main body portion around a turning axis provided at the other side edge thereof across the recording sheet delivery path, said image-forming apparatus comprising:

a nearly rectangular manual sheet feeder tray having a first edge portion extending in a direction crossing the recording sheet delivery path, and being hinged turnably to the lower main body portion at the side of the sheet feed unit, and a second edge portion being positioned near a space between the upper main body portion pushed up by the opener assembly and the lower main body portion on a sheet feed unit side and extending at the side opposite to the first edge portion and in the crossing direction, the manual sheet feeder tray being positioned selectively for a working mode by bringing down the second edge portion by turning around the first edge portion, or for a non-working mode by turning up the second edge portion around the first edge portion as the turning axis to be fixed; and the manual sheet feeder tray overlapping a part of a side wall of the upper main body portion to be in contact therewith in the non-working mode irrespective of the opener assembly being open or close.

2. An image-forming apparatus having a recording sheet-delivery path for delivering a recording sheet from a sheet feed unit to a sheet discharge unit in an opposite side; and being separable into two portions of an upper main body portion and a lower main body portion by opening an opener assembly from one side edge of the upper main body portion around a turning axis provided at the other side edge thereof across to the recording sheet delivery path, said image-forming apparatus comprising:

a nearly rectangular manual sheet feeder tray having a first edge portion extending in a direction crossing the recording sheet delivery path, and being hinged turnably to the lower main body portion at the side of the sheet feed unit, and a second edge portion being positioned near a space between the upper main body portion pushed up by the opener assembly and the lower main body portion on a sheet feed unit side and extending at the side opposite to the first edge portion and in the crossing direction, the manual sheet feeder tray being positioned selectively for a working mode by bringing down the second edge portion by turning around the first edge portion, or for a non-working mode by turning up the second edge portion around the first edge portion as the turning axis to be fixed; and comprising a guide member for guiding the manual sheet feeder tray temporarily outside the upper main body portion in losing the upper main body portion from an open state to prevent contact of the manual sheet feeder tray with the upper main body portion.

3. An image-forming apparatus having a recording sheet-delivery path for delivering a recording sheet from a sheet feed unit to a sheet discharge unit in an opposite side; and being separable into two portions of an upper main body portion and a lower main body portion by opening an opener assembly from one side edge of the upper main body portion around a turning axis provided at the other side edge thereof across the recording sheet delivery path, said image-forming apparatus comprising:

a discharged-sheet tray having a first edge portion extending in a direction crossing to the recording sheet delivery path, and being hinged turnably to the lower main body portion at the side of the sheet discharge unit, and a second edge portion being positioned near a space between the upper main body portion pushed up by the opener assembly and the lower main body portion on a sheet feed unit side and extending at the side opposite to the first edge portion and in the crossing direction;

the discharged-sheet tray being positioned selectively for a working mode by bringing down the second edge portion by turning around the first edge portion, or for a non-working mode by turning up the second edge portion around the first edge portion as the turning axis to be fixed; and the discharged-sheet tray overlapping a part of a side wall of the upper main body portion to be in contact therewith in the non-working mode irrespective of the opener assembly being open or close.

4. An image-forming apparatus having a recording sheet-delivery path for delivering a recording sheet from a sheet feed unit to a sheet discharge unit in an opposite side; and being separable into two portions of an upper main body portion and a lower main body portion by opening n opener assembly from one side edge of the upper main body portion around a turning axis provided at the other side edge thereof across the recording sheet delivery path, said image-forming apparatus comprising:

a discharged-sheet tray having a first edge portion extending in a direction crossing the recording sheet delivery path, and being hinged turnably to the lower main body portion at the side of the sheet discharge unit, and a second edge portion being positioned near a space between the upper main body portion pushed up by the opener assembly and the lower main body portion on a sheet feed unit side and extending at the side opposite to the first edge portion and in the crossing direction;

the discharged-sheet tray being positioned selectively for a working mode by bringing down the second edge portion by turning around the first edge portion, or for a non-working mode by turning up the second edge portion around the first edge portion as the turning axis to be fixed; and comprising a guide member for guiding the discharged-sheet tray temporarily outside the upper main body portion in closing the upper main body portion from an open state to prevent contact of the discharged-sheet tray with the upper main body portion.

* * * * *